US012588731B1

(12) United States Patent
Rivera

(10) Patent No.: US 12,588,731 B1
(45) Date of Patent: Mar. 31, 2026

(54) TRANSFORMING SHOE SOLE

(71) Applicant: Aziana Rivera, Lake City, PA (US)

(72) Inventor: Aziana Rivera, Lake City, PA (US)

( * ) Notice: Subject to any disclaimer, the term of this patent is extended or adjusted under 35 U.S.C. 154(b) by 75 days.

(21) Appl. No.: 18/899,349

(22) Filed: Sep. 27, 2024

(51) Int. Cl.
*A43B 3/24* (2006.01)

(52) U.S. Cl.
CPC ..... *A43B 3/246* (2013.01)

(58) Field of Classification Search
CPC ..... A43B 3/24; A43B 3/246; A43B 3/244; A43B 21/433; A43B 3/0047
See application file for complete search history.

(56) References Cited

U.S. PATENT DOCUMENTS

| | | | | |
|---|---|---|---|---|
| 5,410,820 | A | 5/1995 | Goodman | |
| 7,975,405 | B1 | 7/2011 | Kemp | |
| 9,648,921 | B2 * | 5/2017 | Weller | A43B 3/246 |
| 10,039,340 | B2 | 8/2018 | Berberian et al. | |
| 10,842,222 | B2 | 11/2020 | Zahabian | |
| 11,304,478 | B2 | 4/2022 | Berberian | |
| 11,523,654 | B2 | 12/2022 | Davis et al. | |
| 12,042,010 | B2 * | 7/2024 | Fusaro | A43B 21/433 |
| 2013/0326913 | A1 * | 12/2013 | Weller | A43B 13/141 36/105 |
| 2013/0333246 | A1 * | 12/2013 | Weller | A43B 3/26 36/103 |
| 2014/0298685 | A1 | 10/2014 | Alan et al. | |
| 2015/0047223 | A1 | 2/2015 | Flinterman et al. | |
| 2018/0049516 | A1 * | 2/2018 | Chiang | A43B 21/433 |
| 2018/0213889 | A1 * | 8/2018 | Riebe | A43B 21/433 |
| 2020/0297075 | A1 * | 9/2020 | Fusaro | A43B 21/437 |
| 2020/0323308 | A1 | 10/2020 | Dubuisson | |
| 2021/0068494 | A1 | 3/2021 | Zahabian | |
| 2021/0177086 | A1 | 6/2021 | Caulk et al. | |
| 2022/0117358 | A1 * | 4/2022 | Fusaro | A43B 3/246 |

* cited by examiner

*Primary Examiner* — Haley A Smith
(74) *Attorney, Agent, or Firm* — Cramer Patent & Design, PLLC.; Aaron R. Cramer

(57) ABSTRACT

The transforming shoe sole may have a sole body, a toe plate, a toe hinge, a heel, a heel hinge, a toe-angle push rod, and a heel-release mechanism. The transforming shoe sole may be a sole for a shoe that may be reconfigured between a flat shoe configuration and a heeled shoe configuration. The heel may pivot downwards and may lock into place to convert from the flat shoe configuration to the heeled shoe configuration. The heel-release mechanism may release the heel to pivot upwards into the sole body to convert from the heeled shoe configuration to the flat shoe configuration. A toe angle may change responsive to pivoting of the heel. The sole may be coupled to one or more straps, an enclosed upper, or both to form a complete shoe.

10 Claims, 4 Drawing Sheets

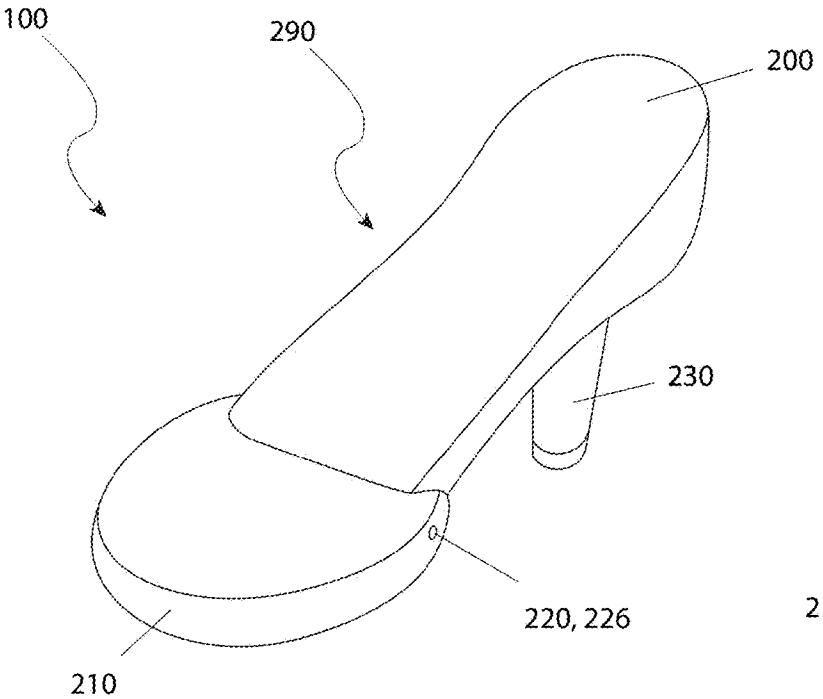
FIG. 1
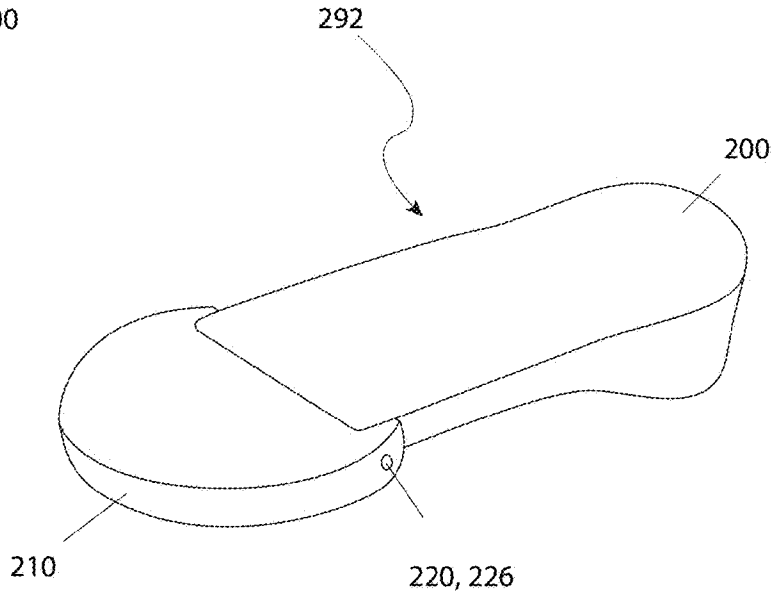
FIG. 2
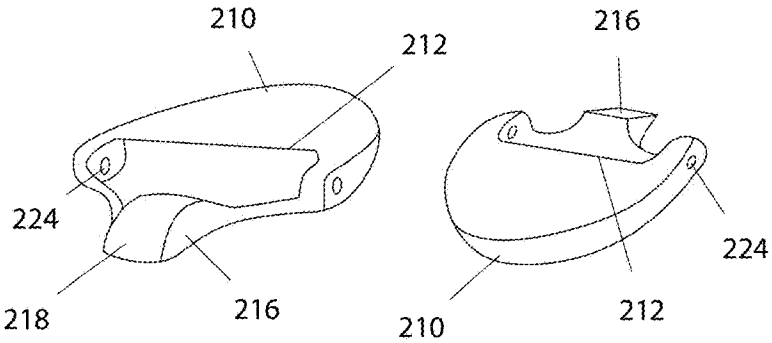
FIG. 3a
FIG. 3b
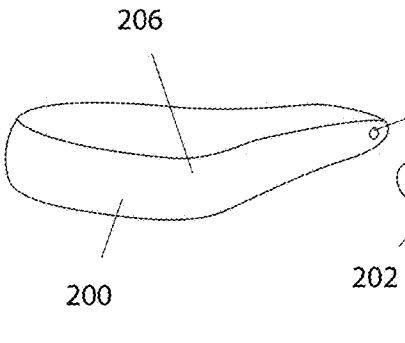
FIG. 4a
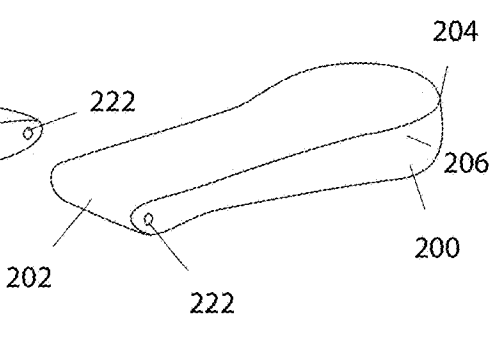
FIG. 4b

TRANSFORMING SHOE SOLE

RELATED APPLICATIONS

None.

FIELD OF THE DEVICE

The device of the present application falls under the category of footwear, specifically transforming shoe soles. This field encompasses innovations in shoe design and functionality, aimed at providing versatility and adaptability in footwear by allowing a single shoe sole to transition between different configurations, such as flat and heeled, to meet various aesthetic and functional needs.

BACKGROUND OF THE DEVICE

Traditional footwear is typically limited to a single configuration, such as flat shoes or high heels, which restricts the versatility and adaptability of the footwear to different occasions and user preferences. This limitation often results in the need for multiple pairs of shoes to suit different purposes, increasing the cost and storage requirements for users. The concept of transforming shoe soles addresses this issue by providing a single shoe sole capable of transitioning between multiple configurations, such as from a flat shoe to a heeled shoe. This innovation not only enhances the functionality and convenience of footwear but also offers potential benefits in terms of cost savings and reduced environmental impact by minimizing the need for multiple pairs of shoes. The present device builds on this concept, introducing a transforming shoe sole with a sophisticated mechanism that ensures a smooth and secure transition between configurations, providing both style and practicality for the user.

SUMMARY OF THE DEVICE

Embodiments of the present disclosure may include a transforming shoe sole featuring a sole body with a semioval shape, a laterally narrower front, and a vertically thicker rear. The toe plate may include a toe plate depression and a toe angle leverage point with a toe plate inclined surface. The toe hinge may pivotally couple the toe plate to the front of the sole body, secured with a toe hinge pin passing through a first sole body hinge aperture and a toe plate hinge aperture.

The heel may feature a heel shaft, a heel cam, a heel stop, and a heel lock aperture. The heel hinge pivotally couples the heel to the bottom rear of the sole body, secured with a heel hinge pin passing through a second sole body hinge aperture and a heel hinge aperture.

A heel-release mechanism may include a left heel release and a right heel release, each equipped with a lock pin, a release button, a left heel release spring, and a right heel release spring. The toe-angle push rod, including a heel end and a toe end, is slidably retained by a toe rod track and interacts with the toe plate to adjust the toe angle in response to the heel's movement.

A push rod spring supports the toe-angle push rod. The left heel release and right heel release each include a J-shaped lock pin that engages the heel cam to prevent pivoting in a heeled shoe configuration. The push rod spring may be configured to force the toe-angle push rod rearwards in a flat shoe configuration, causing the front of the toe plate to pivot downward.

The toe plate depression may be configured to allow the toe plate to pivot upward when transitioning from a flat shoe configuration to a heeled shoe configuration. The heel shaft, heel cam, and heel stop may pivot downward from the bottom rear of the sole body in the heeled shoe configuration.

The heel-release mechanism locks the heel in place in the heeled shoe configuration and allows the heel to pivot upward into the sole body in the flat shoe configuration. The toe-angle push rod's heel end may interact with the toe angle leverage point to adjust the toe angle when the heel pivots.

The toe hinge pin, heel hinge pin, and lock pins may be made of stainless steel. The sole body, toe plate, and heel may be made of materials selected from the group consisting of wood, plastic, metal, and composite resins. The toe hinge, heel hinge, and lock pin apertures may include tubular metal liners to reduce mechanical wear.

The transforming shoe sole may include a flat shoe configuration where the heel pivots upward into the sole body. It may also include a heeled shoe configuration where the heel pivots downward from the bottom rear of the sole body and is locked into place by the heel-release mechanism.

BRIEF DESCRIPTION OF THE DRAWINGS

The advantages and features of the present device will become better understood with reference to the following more detailed description and claims taken in conjunction with the accompanying drawings, in which like elements are identified with like symbols, and in which:

FIG. 1 is an isometric view of a transforming shoe sole 100, according to an embodiment of the present device, illustrating the heeled shoe configuration 290;

FIG. 2 is an isometric view of a transforming shoe sole 100, according to an embodiment of the present device, illustrating the flat shoe configuration 292;

FIG. 3*a* is a rear isometric view of a transforming shoe sole 100, according to an embodiment of the present device, illustrating the toe plate 210;

FIG. 3*b* is a front isometric view of a transforming shoe sole 100, according to an embodiment of the present device, illustrating the toe plate 210;

FIG. 4*a* is a rear isometric view of a transforming shoe sole 100, according to an embodiment of the present device, illustrating the sole body 200;

FIG. 4*b* is a front isometric view of a transforming shoe sole 100, according to an embodiment of the present device, illustrating the sole body 200;

DESCRIPTIVE KEY

Figure 5:
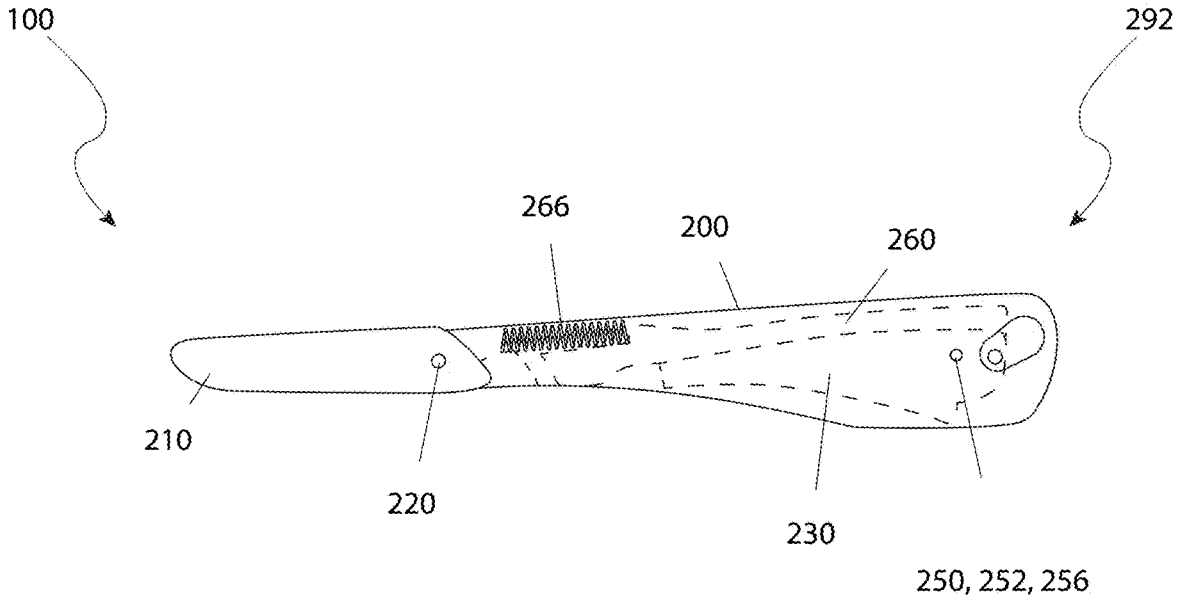
FIG. 5 is a side detail view of a transforming shoe sole 100, according to an embodiment of the present device, illustrating the flat shoe configuration 292.
Figure 6:
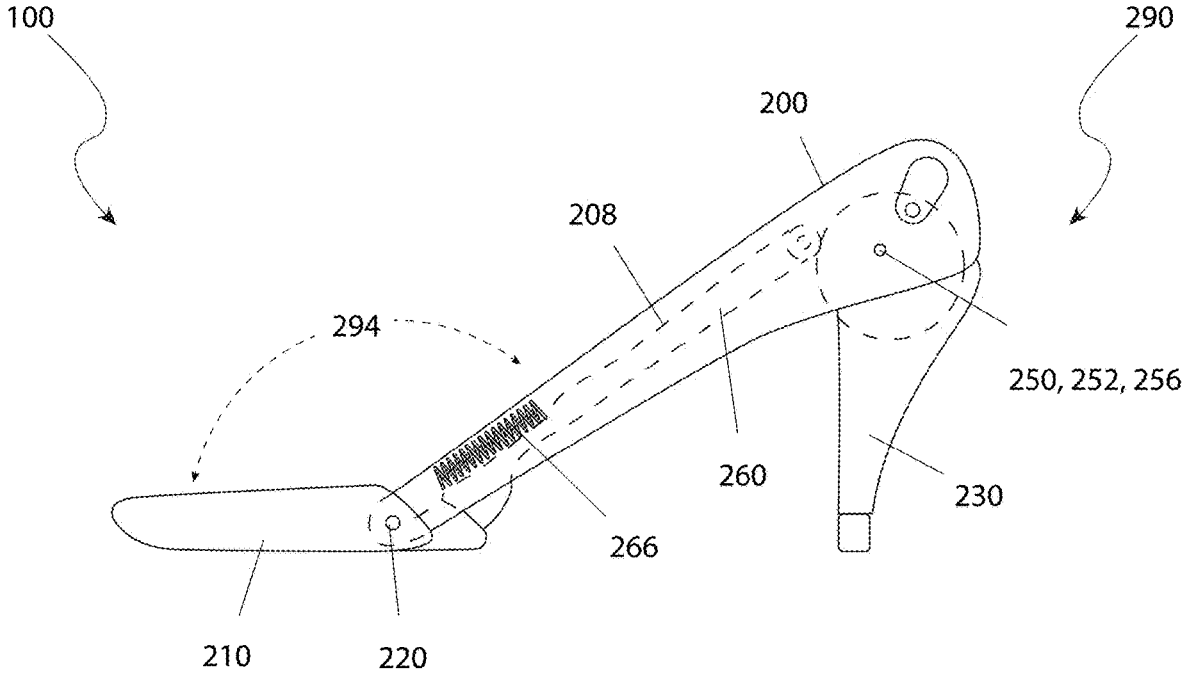
FIG. 6 is a side detail view of a transforming shoe sole 100, according to an embodiment of the present device, illustrating the heeled shoe configuration 290.
Figure 7:
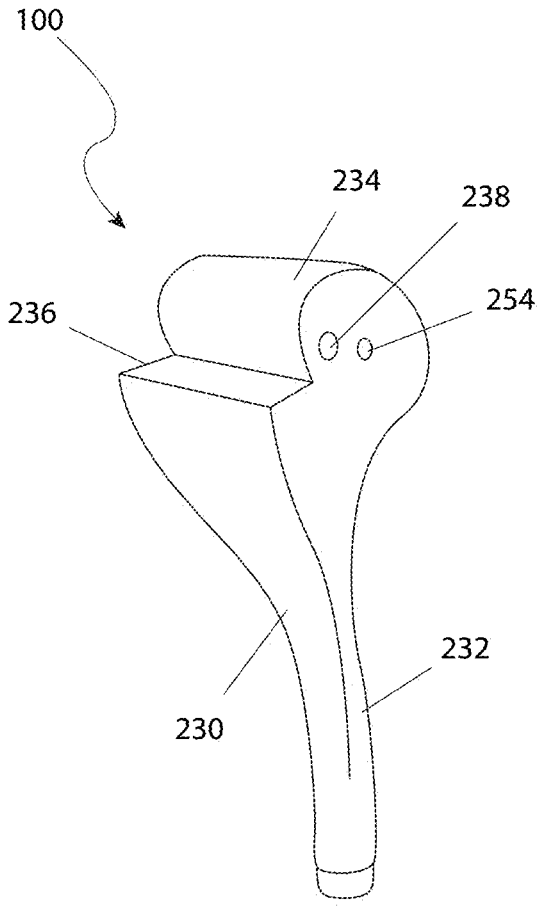
FIG. 7 is a rear isometric view of a transforming shoe sole 100, according to an embodiment of the present device, illustrating the heel 230.
Figure 8:
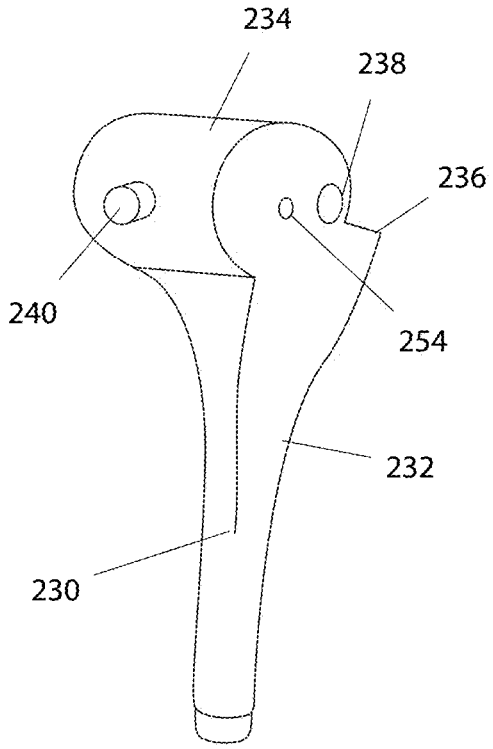
FIG. 8 is a front isometric view of a transforming shoe sole 100, according to an embodiment of the present device, illustrating the heel 230.
Figure 9:
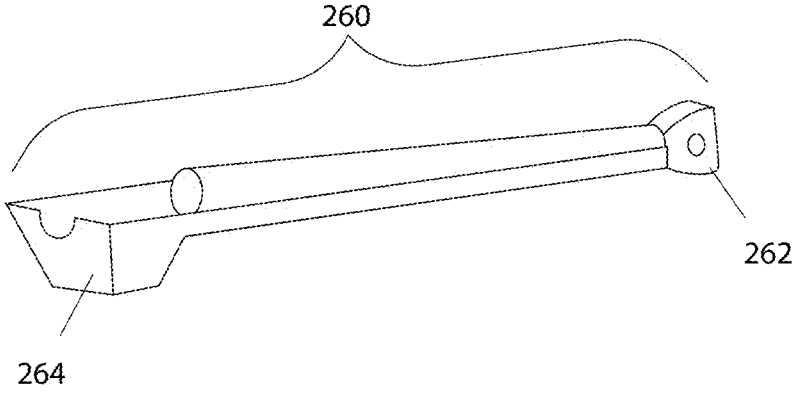
FIG. 9 is an isometric view of a transforming shoe sole 100, according to an embodiment of the present device, illustrating the toe-angle push rod 260.
Figure 10:
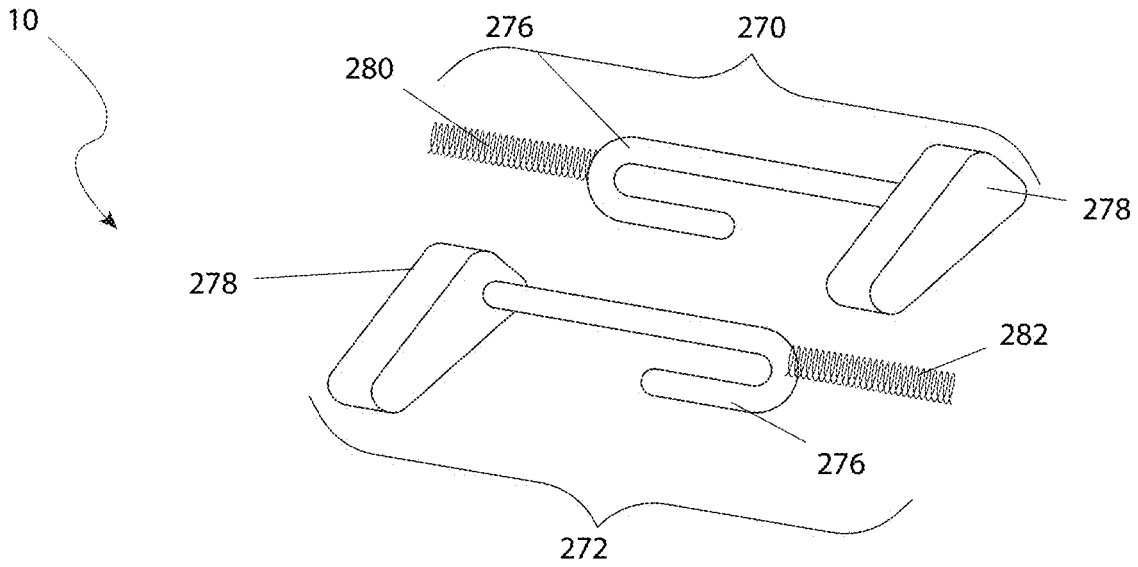
FIG. 10 is a detail view of a transforming shoe sole 100, according to an embodiment of the present device, illustrating the left heel release 270 and the right heel release 272; and, FIG. 11 is a detail view of a transforming shoe sole 100, according to an embodiment of the present device, illustrating the heel release mechanism.
Figure 11:
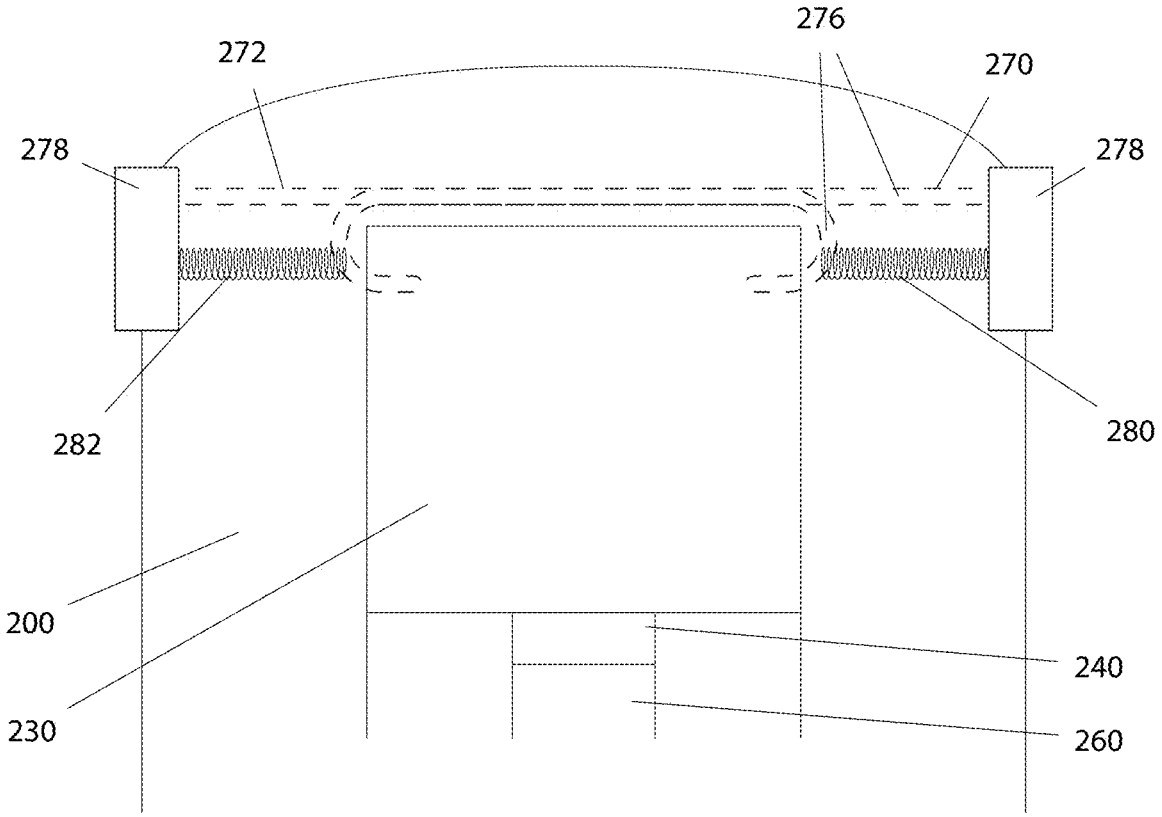

100 transforming shoe sole
200 sole body
202 laterally narrower front
204 vertically thicker rear
206 locking pin aperture
208 toe rod track
210 toe plate
212 toe plate depression
216 toe angle leverage point
218 toe plate inclined surface
220 toe hinge
222 first sole body hinge aperture
224 toe plate hinge aperture
226 toe hinge pin
230 heel
232 heel shaft
234 heel cam
236 heel stop
238 heel lock aperture
240 toe rod protrusion
250 heel hinge
252 second sole body hinge aperture
254 heel hinge aperture
256 heel hinge pin
260 toe-angle push rod
262 heel end
264 toe end
266 push rod spring
270 left heel release
272 right heel release
276 lock pin
278 release button
280 left heel release spring
282 right heel release spring
290 heeled shoe configuration
292 flat shoe configuration
294 toe angle

1. DESCRIPTION OF THE DEVICE

The present device is directed to a transforming shoe sole (herein described as the "device") 100. The device 100 may comprise a sole body 200, a toe plate 210, a toe hinge 220, a heel 230, a heel hinge 250, a toe-angle push rod 260, and a heel-release mechanism. The device 100 may be a sole for a shoe that may be reconfigured between a flat shoe configuration 292 and a heeled shoe configuration 290. The heel 230 may pivot downwards and may lock into place to convert from the flat shoe configuration 292 to the heeled shoe configuration 290. The heel-release mechanism may release the heel 230 to pivot upwards into the sole body 200 to convert from the heeled shoe configuration 290 to the flat shoe configuration 292. A toe angle 294 may change responsive to pivoting of the heel 230. As non-limiting examples, the sole may be coupled to one (1) or more straps, an enclosed upper, or both to form a complete shoe.

As non-limiting examples, the heeled shoe configuration 290 may comprise high-heels, kitten heels, and stiletto heels.

The toe plate 210 may be hingedly coupled to the front of the sole body 200 to form the sole. The sole may comprise lateral and/or vertical contours that may be adapted to fit the shape of a human foot. The sole may comprise both a left foot configuration and a right foot configuration which may be mirror images of each other.

As seen from above, the sole body 200 may be substantially semioval-shaped with a curvature located on the rear of the sole body 200. The sole body 200 may comprise a laterally narrower front 202, a vertically thicker rear 204, or both.

The sole body 200 may comprise a toe rod track 208 which may slidably retain the toe-angle push rod 260 to the sole body 200.

As seen from above, the toe plate 210 may be substantially semioval-shaped with a curvature located on the front of the toe plate 210. The top rear of the toe plate 210 may comprise a toe plate depression 212. The toe plate depression 212 may be a low area of the toe plate 210 where the front of the sole body 200 may overlap the toe plate 210 as a portion of the toe hinge 220. The depth of the toe plate depression 212 may be substantially the same as the thickness of the front of the sole body 200 such that the top of the toe plate 210 and the top of the sole body 200 are at substantially the same height in the flat shoe configuration 292. The toe plate depression 212 may be wider than the front of the sole body 200 such that the front of the sole body 200 may fit into the toe plate depression 212. The rear of the toe plate 210 may be wider than the toe plate depression 212 such that the toe plate depression 212 is hidden from view on the exterior of the sole.

The rear of the toe plate 210 may further comprise a toe angle leverage point 216. The toe angle leverage point 216 may be a rearward extension of the center of the toe plate 210 comprising a toe plate inclined surface 218 such that the toe-angle push rod 260 may press against the toe angle leverage point 216 to pivot the front of the toe plate 210 upwards. The toe plate inclined surface 218 may be higher at the front and lower at the rear to match the orientation of the rear of the toe-angle push rod 260.

The rear of the toe plate 210 may be coupled to the front of the sole body 200 via the toe hinge 220. As a non-limiting example, the toe hinge 220 may comprise alignment of a first sole body hinge aperture 222 passing laterally through the front of the sole body 200 with a toe plate hinge aperture 224 passing laterally through the rear of the toe plate 210 and a toe hinge pin 226 that passes through both the first sole body hinge aperture 222 and the toe plate hinge aperture 224. The toe plate 210 may pivot at the toe hinge pin 226 relative to the sole body 200.

The heel 230 may pivot downward from the bottom rear of the sole body 200 in the heeled shoe configuration 290 and may pivot up and forward into a heel cavity in the sole body 200 in the flat shoe configuration 292. The heel 230 may comprise a heel shaft 232, a heel cam 234, a heel stop 236, and a toe rod protrusion 240. The heel shaft 232 may be an armature that extends downward in the heeled shoe configuration 290 to elevate the rear of the sole. The top of the heel shaft 232 may be coupled to the heel cam 234. The heel cam 234 may be pivotably coupled to the sole body 200 via the heel hinge 250. The heel stop 236 may be a rearward extension of the heel shaft 232 and the heel cam 234. The heel stop 236 may limit the rotation of the heel 230 and may provide a support structure between the rear of the sole body 200 and the heel 230. The toe rod protrusion 240 may be a projection from the heel cam 234 that is opposite the heel stop 236. The toe rod protrusion 240 may push the toe-angle push rod 260 forward in the heeled shoe configuration 290 such that the toe-angle push rod 260 pressed against the toe angle leverage point 216 to pivot the toe plate 210.

The heel 230 may be coupled to the sole body 200 via the heel hinge 250. As a non-limiting example, the heel hinge 250 may comprise alignment of a second sole body hinge aperture 252 passing laterally through the heel cam 234 with a heel hinge aperture 254 passing laterally through the rear of the sole body 200 and a heel hinge pin 256 that passes through both the second sole body hinge aperture 252 and the heel hinge aperture 254. The heel 230 may pivot at the heel hinge pin 256 relative to the sole body 200.

The toe-angle push rod 260 may slidably couple to the sole body 200 via the toe rod track 208. A heel end 262 of the toe-angle push rod 260 may be pushed forward by the toe rod protrusion 240 in the heeled shoe configuration 290. Responsive to the toe-angle push rod 260 being pushed forward, a toe end 264 of the toe-angle push rod 260 may press against the toe plate inclined surface 218 of the toe angle leverage point 216 and may force the front of the toe plate 210 to pivot upwards. A push rod spring 266 coupled between the sole body 200 and the toe-angle push rod 260 may push the toe-angle push rod 260 rearwards in the flat shoe configuration 292 such that the front of the toe plate 210 pivots downward.

The heel-release mechanism may lock the heel 230 into position in the heeled shoe configuration 290. The heel-release mechanism may comprise a left heel release 270, a right heel release 272, a left heel release spring 280, and a right heel release spring 282. The left heel release 270 may be located at the left rear of the sole body 200 and the right heel release 272 may be located at the right rear of the sole body 200. The left heel release spring 280 may apply a force to the left heel release 270 causing the left heel release 270 to engage the heel cam 234 in the heeled shoe configuration 290. The right heel release spring 282 may apply a force to the right heel release 272 causing the right heel release 272 to engage the heel cam 234 in the heeled shoe configuration 290.

An individual heel release selected from the left heel release 270 and the right heel release 272 may comprise a lock pin 276 and a release button 278. The lock pin 276 may be a J-shaped armature. The long leg of the lock pin 276 may pass laterally behind the heel 230, turn to the front and extend forward past the rear of the heel cam 234, and then turn towards the center of the heel 230. Responsive to force applied by an individual heel spring selected from the left heel release spring 280 and the right heel release spring 282, the short leg of the lock pin 276 may engage one (1) of a set of heel lock apertures 238 in the heeled shoe configuration 290 such that the heel 230 may be prevented from pivoting.

The long leg of the lock pin 276 may be coupled to the release button 278 such that the release button 278 is accessible outside of the sole. The release button 278 may be adapted to be pressed by a user to overcome the force of the individual heel spring such that the lock pin 276 may disengage the heel cam 234. Pivoting the heel 230 from the heeled shoe configuration 290 to the flat shoe configuration 292 may require pressing both the left heel release 270 and the right heel release 272 at the same time.

The lock pins 276 may pass through the shoe via a set of locking pin apertures 206. The set of locking pin apertures 206 may be at staggered heights to avoid mechanical interference between the lock pin 276 for the left heel release 270 and the lock pin 276 for the right heel release 272. The lock pin 276 of the left heel release 270 may couple to the release button 278 on the left heel release 270 at a different height than the lock pin 276 of the right heel release 272 couples to the release button 278 on the right heel release 272 such that the release button 278 on the left heel release 270 may be at the same height as the release button 278 on the right heel release 272 even though the heights of the lock pins 276 are staggered.

The specific dimensions of the device 100 may vary in order to match a shoe size. As non-limiting examples, the toe hinge pin 226, the heel hinge pin 256, and the lock pin 276 of both the left heel release 270 and the right heel release 272 may be made of stainless steel. As non-limiting examples, the sole body 200, the toe plate 210, and the heel 230 may be made of wood, plastic, metal, composite resins, or any combination thereof. In some embodiments, the set of locking pin apertures 206, the first sole body hinge aperture 222, the second sole body hinge aperture 252, the toe plate hinge aperture 224, the set of heel lock apertures 238, the heel hinge aperture 254, or any combination thereof may comprise tubular metal liners in order to reduce mechanical wear.

In use, a user may convert a flat shoe configuration 292 to a heeled shoe configuration 290 by lifting a foot and pulling down on the heel 230 such that the heel 230 pivots downward and rearward. As the heel 230 pivots, the toe rod protrusion 240 on the heel cam 234 may push the toe-angle push rod 260 forward against the toe angle leverage point 216 of the toe plate 210 and may cause the toe plate 210 to pivot such that the front of the toe plate 210 lifts up. The left heel release 270 and the right heel release 272 may engage the heel cam 234 to lock the heel 230 in place and the rear of the sole may rest on the heel stop 236 for support and improved appearance.

The user may convert the heeled shoe configuration 290 to the flat shoe configuration 292 by lifting a foot and pressing in on both the left heel release 270 and the right heel release 272 simultaneously. The left heel release 270 and the right heel release 272 may disengage from the heel cam 234 and the push rod spring 266 may force the toe-angle push rod 260 rearwards such that the heel cam 234 may partially rotate. The left heel release 270 and the right heel release 272 may be released and the heel 230 may be pivoted forward and upward into the bottom of the sole.

Another embodiment of the transforming shoe sole 100 consists of all essential elements meticulously designed to facilitate its dual functionality. The primary structure, the sole body 200, is semioval-shaped and crafted to fit the contours of a human foot, featuring a laterally narrower front 202 and a vertically thicker rear 204. The toe plate 210, which includes a toe plate depression 212 and a toe angle leverage point 216 with a toe plate inclined surface 218, is hingedly coupled to the front of the sole body 200 via the toe hinge 220, allowing it to pivot upward when transitioning from the flat shoe configuration 292 to the heeled shoe configuration 290. This hinge is secured with a toe hinge pin 226 that passes through both the first sole body hinge aperture 222 and the toe plate hinge aperture 224.

The heel 230, featuring a heel shaft 232, heel cam 234, heel stop 236, and heel lock aperture 238, pivots downward from the bottom rear of the sole body 200. The heel is coupled via the heel hinge 250, secured with a heel hinge pin 256 passing through the second sole body hinge aperture 252 and the heel hinge aperture 254. The heel is locked into place using a sophisticated heel-release mechanism comprising left heel release 270 and right heel release 272, each equipped with a lock pin 276, release button 278, left heel release spring 280, and right heel release spring 282.

A toe-angle push rod 260, which includes a heel end 262 and toe end 264, and is slidably retained by a toe rod track 208, interacts with the toe plate 210 to adjust the toe angle 294 in response to the heel's movement. The push rod is supported by a push rod spring 266 that facilitates the adjustment. The mechanism ensures a smooth transition between the flat shoe configuration 292 and the heeled shoe configuration 290, providing both style and functionality. This innovative design, featuring all the specified elements, ensures versatility and durability, making it an ideal choice for those seeking adaptable footwear.

The exact specifications, materials used, and method of use of the device 100 may vary upon manufacturing. The foregoing descriptions of specific embodiments of the present device have been presented for purposes of illustration and description. They are not intended to be exhaustive or to limit the device to the precise forms disclosed, and obviously many modifications and variations are possible in light of the above teaching. The embodiments were chosen and described in order to best explain the principles of the device and its practical application, to thereby enable others skilled in the art to best utilize the device and various embodiments with various modifications as are suited to the particular use contemplated.

What is claimed is:

1. A transforming shoe sole comprising:

a sole body having a semioval shape, a laterally narrower front, and a vertically thicker rear;

a toe plate including a toe plate depression and a toe angle leverage point with a toe plate inclined surface;

a toe hinge pivotally coupling the toe plate to the front of the sole body, the toe hinge secured with a toe hinge pin passing through a first sole body hinge aperture and a toe plate hinge aperture;

a heel comprising a heel shaft, a heel cam, a heel stop, and a heel lock aperture;

a heel hinge pivotally coupling the heel to the bottom rear of the sole body, the heel hinge secured with a heel hinge pin passing through a second sole body hinge aperture and a heel hinge aperture;

a heel-release mechanism comprising a left heel release and a right heel release, each equipped with a lock pin, a release button, a left heel release spring, and a right heel release spring;

a toe-angle push rod including a heel end and a toe end, the toe-angle push rod being slidably retained by a toe rod track and interacting with the toe plate to adjust the toe angle in response to the heel's movement; and, a push rod spring supporting the toe-angle push rod; and, wherein the left heel release and right heel release each include a J-shaped lock pin that engages the heel cam to prevent pivoting in a heeled shoe configuration; and, wherein the push rod spring is configured to force the toe-angle push rod rearwards in a flat shoe configuration, causing the front of the toe plate to pivot downward.

2. The transforming shoe sole of claim 1, wherein the toe plate depression is configured to allow the toe plate to pivot upward when transitioning from a flat shoe configuration to a heeled shoe configuration.

3. The transforming shoe sole of claim 2, wherein the heel shaft, heel cam, and heel stop are configured to pivot downward from the bottom rear of the sole body in the heeled shoe configuration.

4. The transforming shoe sole of claim 3, wherein the heel-release mechanism locks the heel in place in the heeled shoe configuration and allows the heel to pivot upward into the sole body in the flat shoe configuration.

5. The transforming shoe sole of claim 4, wherein the toe-angle push rod's heel end is configured to interact with the toe angle leverage point to adjust the toe angle when the heel pivots.

6. The transforming shoe sole of claim 5, wherein the toe hinge pin, heel hinge pin, and lock pins are made of stainless steel.

7. The transforming shoe sole of claim 6, wherein the sole body, toe plate, and heel are made of materials selected from the group consisting of wood, plastic, metal, and composite resins.

8. The transforming shoe sole of claim 7, wherein the toe hinge, heel hinge, and lock pin apertures include tubular metal liners to reduce mechanical wear.

9. The transforming shoe sole of claim 1, further comprising:

the flat shoe configuration where the heel is pivoted upward into the sole body.

10. The transforming shoe sole of claim 1, further comprising:

the heeled shoe configuration where the heel is pivoted downward from the bottom rear of the sole body and locked into place by the heel-release mechanism.

* * * * *